United States Patent [19]

Rehag et al.

[11] 4,386,512

[45] Jun. 7, 1983

[54] PILGER TUBE ROLLING MILL

[75] Inventors: Klaus Rehag, Monchen-Gladbach; Horst Stinnertz, Willich, both of Fed. Rep. of Germany

[73] Assignee: Wean United, Inc., Pa.

[21] Appl. No.: 244,367

[22] Filed: Mar. 16, 1981

[30] Foreign Application Priority Data

Mar. 17, 1980 [DE] Fed. Rep. of Germany ..... 3010526

[51] Int. Cl.[3] ..... B21B 35/14

[52] U.S. Cl. ..... 72/214; 72/249; 74/603

[58] Field of Search ..... 72/189, 214, 249, 449; 74/603

[56] References Cited

U.S. PATENT DOCUMENTS

| | | | |
|---|---|---|---|
| 1,387,720 | 8/1921 | Hult | 74/604 |
| 2,924,106 | 2/1960 | Bohm et al. | 74/44 |
| 3,335,593 | 8/1967 | Zeunert | 72/249 |
| 3,503,241 | 3/1970 | vom Dorp et al. | 72/214 |
| 3,566,658 | 3/1971 | Zeunert | 72/238 |
| 3,584,489 | 6/1971 | Peytavin | 72/208 |
| 4,052,898 | 10/1977 | Miller et al. | 72/214 |

FOREIGN PATENT DOCUMENTS

| | | | |
|---|---|---|---|
| 1086357 | 10/1967 | United Kingdom | 72/214 |

*Primary Examiner*—Lowell A. Larson
*Assistant Examiner*—Jonathan L. Scherer
*Attorney, Agent, or Firm*—Daniel Patch; Suzanne Kikel

[57] ABSTRACT

The disclosure of the present invention relates to a compensating counterweight system used in a cold pilger step-by-step type seamless tube rolling mill reciprocated by a crank assembly. The crank assembly includes first and second compensating mass devices which are arranged to rotate coaxially on a single crank shaft in opposite directions relative to each other. The two mass devices are kinetically connected through a bevel gear drive set which causes the second compensating mass device to rotate in an opposite directon to the first compensating mass device.

6 Claims, 5 Drawing Figures

PILGER TUBE ROLLING MILL

The invention relates to a pilger step-by-step type seamless tube rolling mill with dynamic balancing of the moving masses as generally disclosed in U.S. Pat. No. 3,584,489. With this known pilger step-by-step type seamless tube rolling mill, in one embodiment of U.S. Pat. No. 3,584,489, two crankshafts, one lying above the other, are kinematically connected with each other by a spur gear system and rotate in directions of rotation opposed to each other. Both crankshafts bear eccentric masses complementary to each other for the compensation of the inertial forces of the back-and-forth moving roll stand of a cold pilger rolling mill. The structural height of this known crankshaft is relatively great, because the crankshafts, one lying above the other, and the compensating masses fastened thereon have to be accommodated.

It is an object of the present invention to improve this well known pilger step-by-step type seamless tube rolling mill and to decrease the space required for the crankshaft assemblies.

It is a further object of the subject invention to provide a single crankshaft having counter-rotating compensating mass means in which all compensating masses are arranged one beside the other on this single crankshaft. Furthermore, an advantage of the present invention involving the use of a single crankshaft is that the connecting rods used to reciprocate the mill horizontally can still be connected, as before, to a horizontally arranged crankshaft; however, the rods are now connected to the sides of the mill stand instead of at the top and bottom thereof.

These objects, as well as other novel features and advantages of the present invention will be better appreciated when the following description of several embodiments is read along with the accompanying drawings of which:

Figure 4:
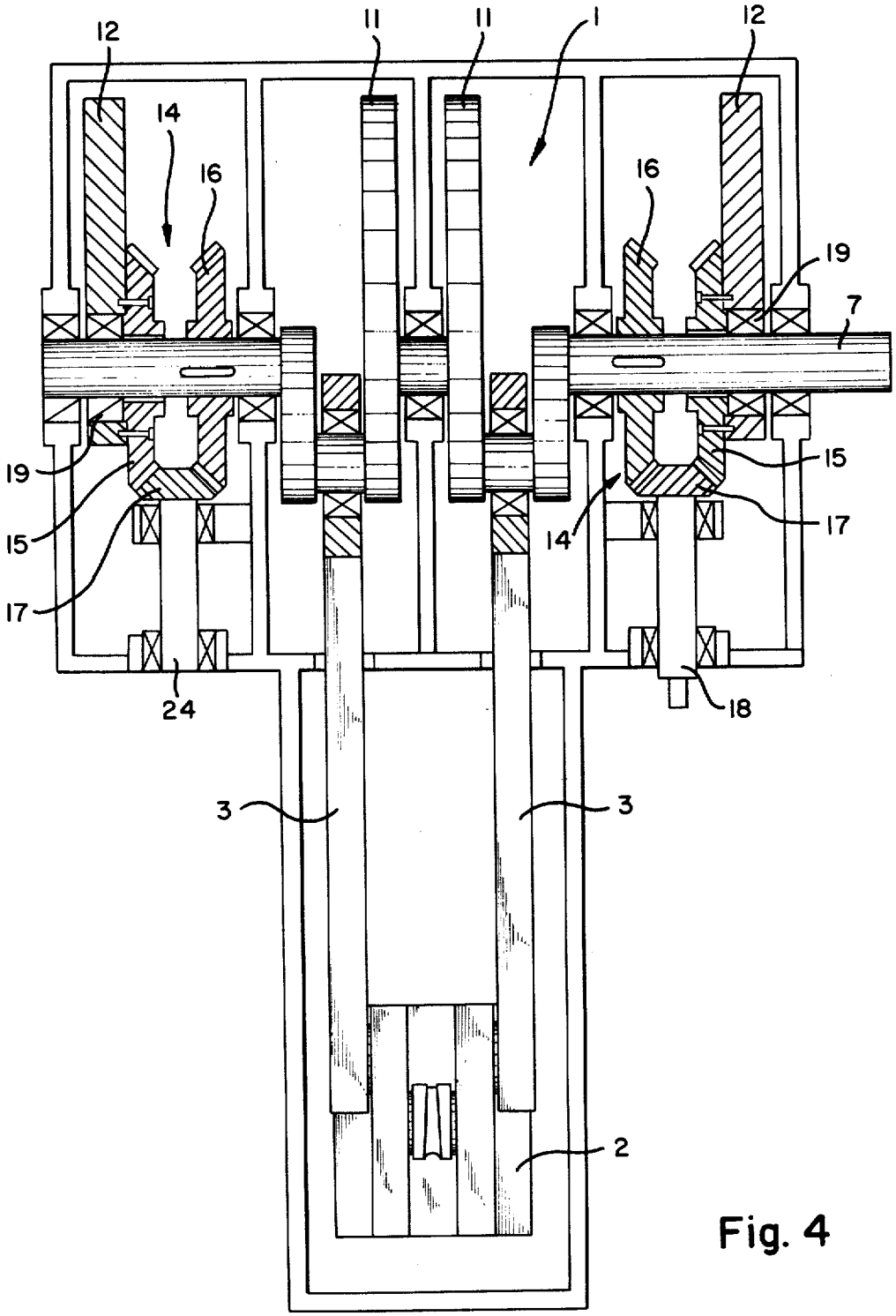
Figure 5:
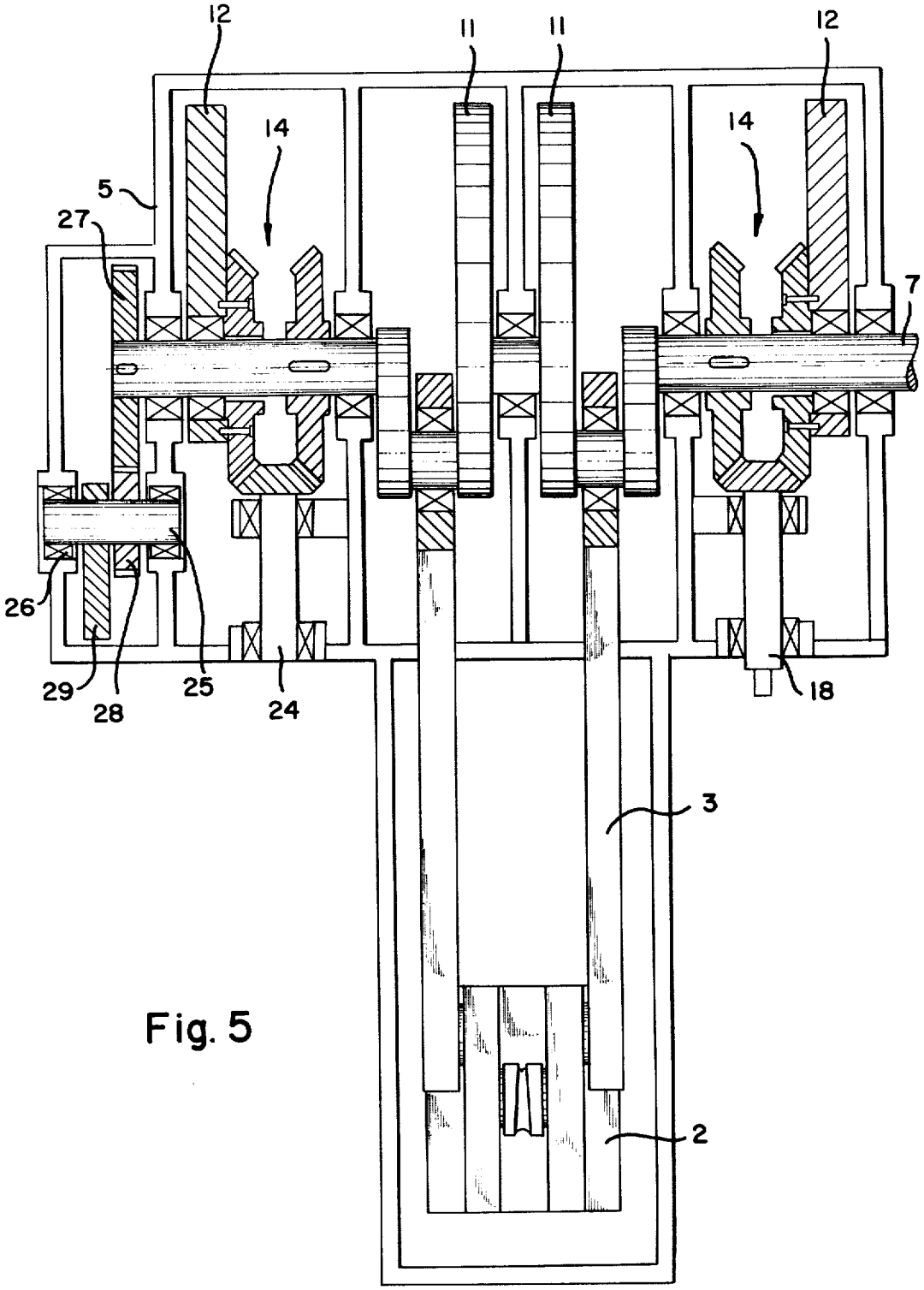

FIG. 4, as a third embodiment, is a plan view partially in section of a cold pilger rolling mill for which the second compensating masses are symmetrically distributed; and FIG. 5 as a fourth embodiment is a plan view of a cold pilger rolling mill similar to FIG. 4, whereby a further additional mass is provided on an auxiliary shaft.

Figure 1:
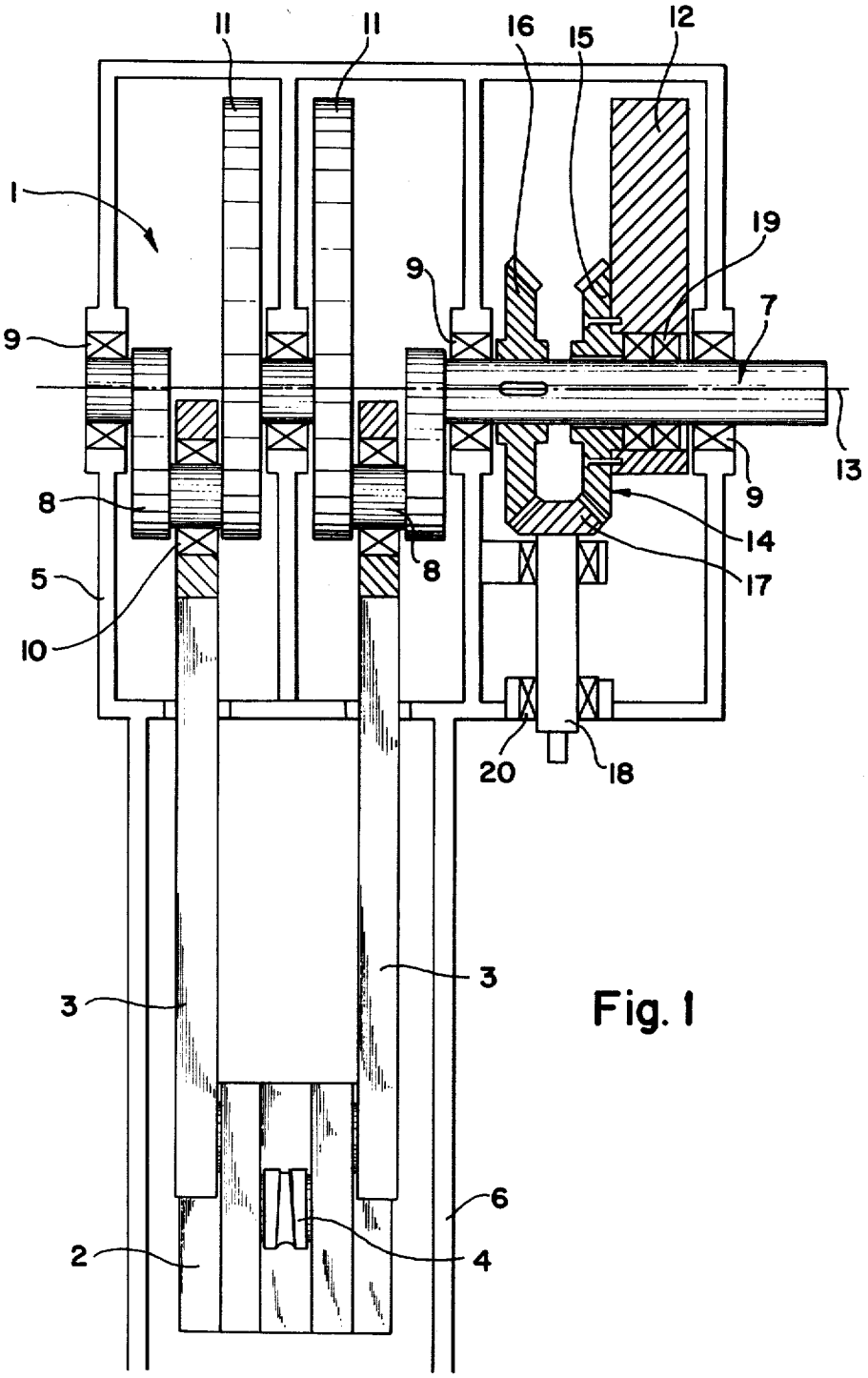
FIG. 1 is a plan view partially in section of a cold pilger rolling mill illustrating a first embodiment of the present invention.

The cold pilger rolling mill illustrated in FIG. 1 consists in essence of a crank assembly 1, a reciprocal stand 2 with annular grooved rolls 4, connecting rods 3 connected to the sides of the stand as well as a housing 5 for the crank assembly 1, and a sliding bed 6 for the stand 2. These components of a pilger mill are similar to that shown in the aforesaid patent as well as those shown in U.S. Pat. Nos. 3,335,593; 3,503,241 and 3,566,658.

Those components comprising the subject invention will now be described and explained. The crank assembly 1 contains a two-throw crankshaft 7, the axis of which is designated with 13. As can be seen, crankshaft 7 extends out of the housing 5 so as to be driven by an external means. The two connecting rods 3 are connected to two cranks 8 of the crankshaft 7 and each are supported thereon by a bearing 10. The bearings supporting the crankshaft 7 in the housing 5 are designated by numeral 9. A first compensating mass means, consisting of two masses 11 are an integral part of the crankshaft 7, and the second mass means consisting of one mass 12 is mounted by bearing 19, directly onto the crankshaft 7. As can be seen, this second compensating mass 12 is, by screws or pins, fixedly secured to and for rotation with a first bevel gear 15 of a bevel gear drive set 14. A second bevel gear 16 of the drive set 14 is attached fixedly to and for rotation with the crankshaft 7. A third bevel gear 17 connects the bevel gears 15 and 16 and is mounted on a shaft 18 supported in the housing 5 by means of bearings 20. The shaft 18 is designed as a power take-off shaft of the crank assembly 1 and drives a gear unit for the mechanical feed and turning mechanism of the mill which is not illustrated, in an advantageous way.

Figure 2:
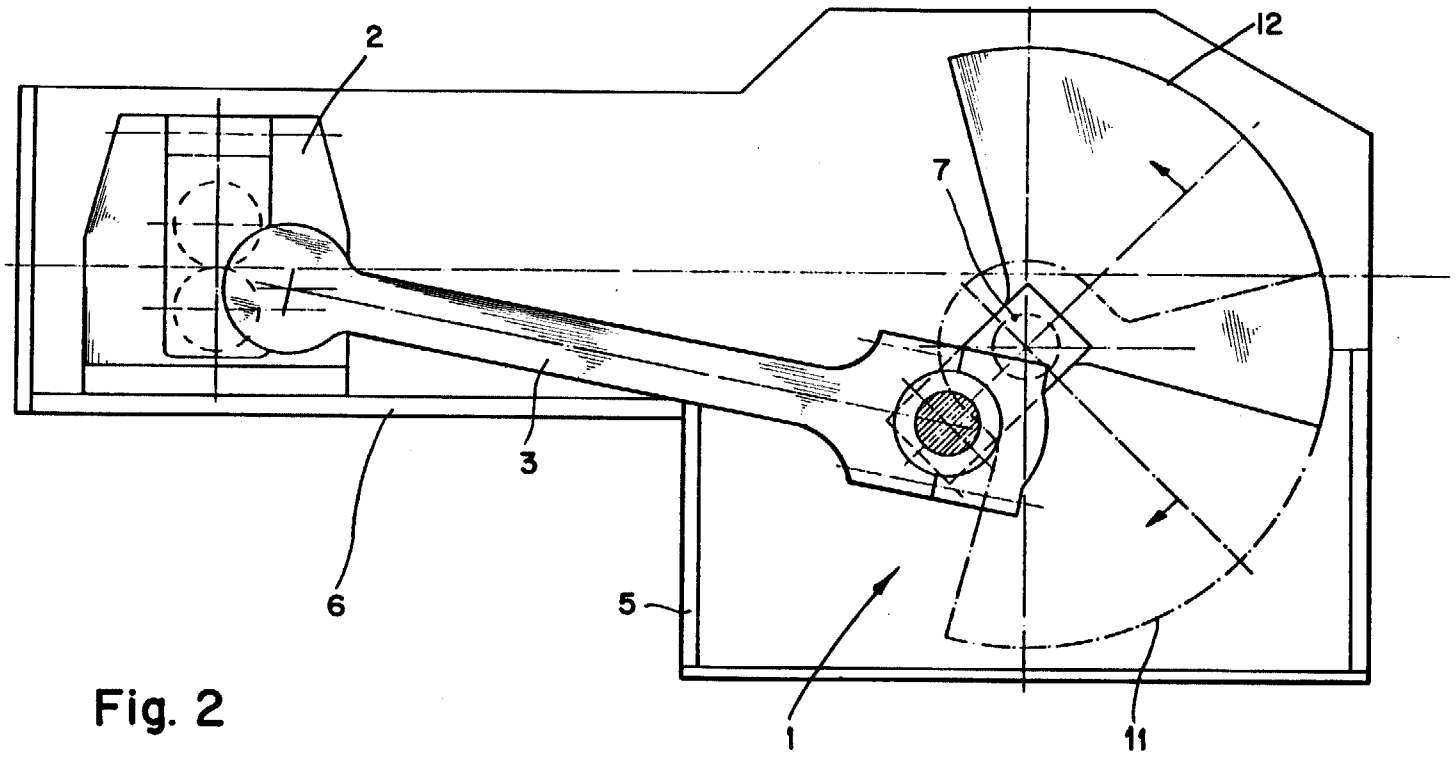
FIG. 2 is a side view according to FIG. 1.

In FIG. 1 as already mentioned, the crankshaft 7 is the main drive shaft. On the one hand, the first compensating masses 11 rotate in the same direction as crankshaft 7; on the other hand, the bevel gear 16 of gear drive set 14, rotating in the same direction as the crankshaft 7, through the bevel gear 17 causes bevel gear 15 along with mass 12 to rotate in the opposite direction. Thus, the second compensating mass 12 moves synchronously with the first compensating masses 11, but in the opposite direction according to the teaching of the aforesaid U.S. Pat. No. 3,584,489. The first and second compensating masses 11 and 12, of all the Figures as indicated in FIG. 2 in particular, are arranged relatively to each other in such a way that when the stand is being moved into its dead center positions during its reciprocation the masses 11 and 12 overlap in each case in assuming their horizontal positions which, as the case may be, is either farthest or closest to the stand.

Figure 3:
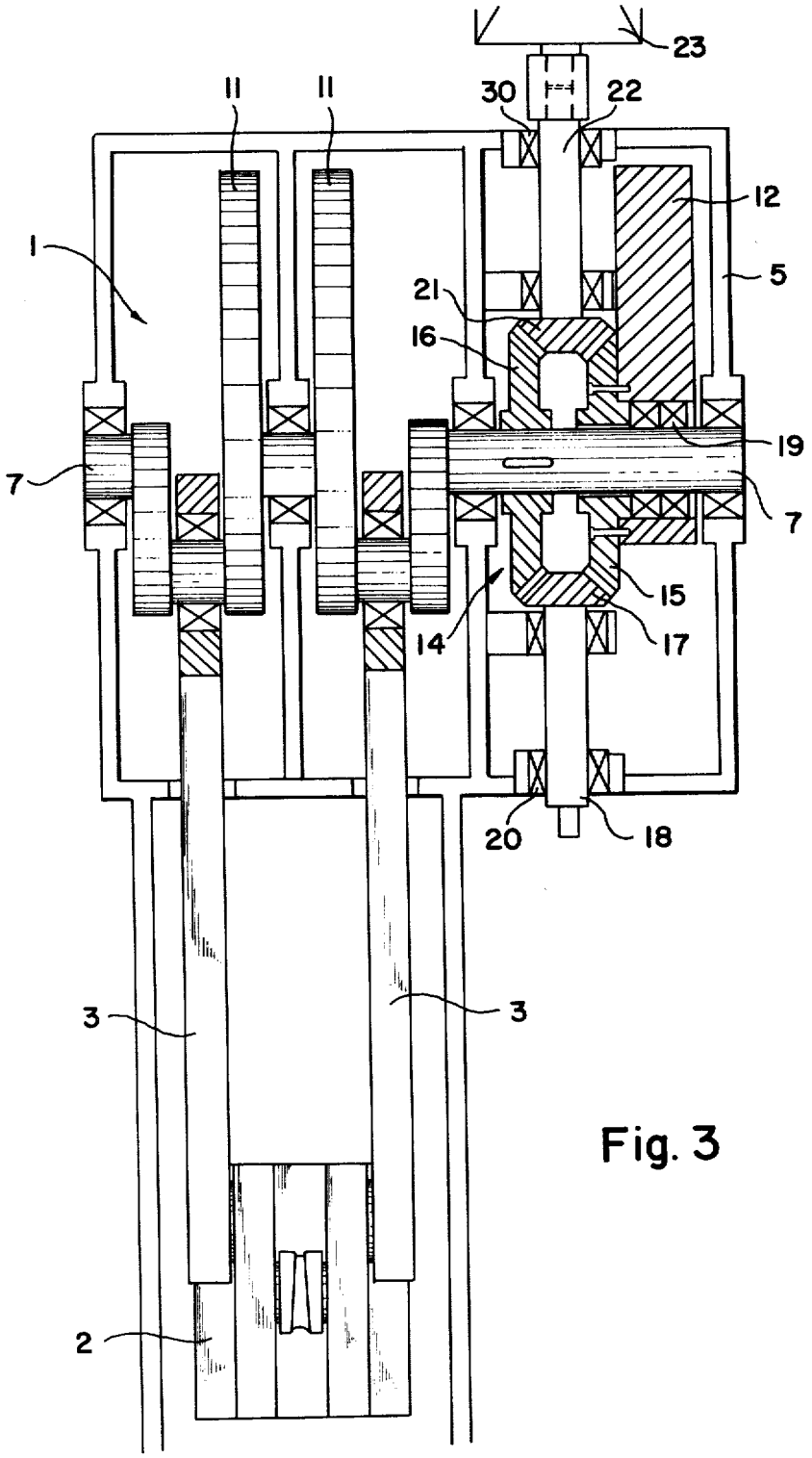
FIG. 3 is a plan view partially in section showing a second embodiment in which the crankshaft drive is effected through a bevel gear drive set.

For the embodiment according to FIG. 3, the gear drive set 14 contains a bevel gear 21 mounted on a shaft 22, which is supported through bearings 30 in the housing 5. The shaft 22 is, in this case, the main drive shaft and through drive motor 23 imparts motion to the crank assembly 1. The construction, arrangement, and operation of the remaining components illustrated in this FIG. 3 are similar to that described above for FIGS. 1 and 2.

The embodiment according to FIG. 4 contains a division of the second compensating mass means into two mass units 12 in which one of these masses are associated with a different one of the first compensating masses 11. As can be seen in FIG. 4, the second mass 12 to the left requires another gearset 14 comprising first and second bevel gears 15 and 16 and a bevel gear 17 which is attached on yet another shaft 24. This second mass unit arrangement to the left of FIG. 4 operates in the same manner as that shown to the right of FIG. 4, and explained with reference to FIGS. 1 and 2.

FIG. 5 shows a further version of the invention which is similar to the basic structure shown in FIG. 4 with an addition of an auxiliary shaft 25, which is brought through a reduction stage by gears 27 and 28 and is given twice the speed (RPM), in comparison to the crankshaft 7. This auxiliary shaft 25 is supported in the housing 5 by bearings 26 and carries a third compensating mass means 29, which is at most half as large in weight as the second compensating masses 12. Mass 29 serves for the compensation of the inertial forces of the second order. The inertial forces of the second order relate to the inertial forces of the first order approximately as the crank radius relates to the length of the connecting rod. Thus, they lie at about 14% in the horizontal direction and at about 20% in the vertical direction for present commercially available type pilger mills. For the embodiment of a cold pilger rolling mill corresponding to FIG. 5, the connecting rod length thus has little or no influence on the residual inertial forces allowing for an optimization of the speed of the mill. It is self-evident that, here as well, an arrangement consisting of counter-rotating masses 29 can be employed for the compensation of the inertial forces of the second order. In FIG. 5, however, only one mass rotating in one direction is provided, since a sufficient effect in connection with a justifiable expenditure is already achieved.

In accordance with the provisions of the patent statutes, we have explained the principle and operation of our invention and have illustrated and described what we consider to represent the best embodiment thereof.

We claim:

1. A pilger step by step seamleass tube rolling mill for the production of a tube, comprising:

a frame for supporting a pair of rotatable rolls, a crank assembly for reciprocating said frame and having a crankshaft, positive drive means for continuously rotating said crank assembly throughout said production, a first compensating mass means fixedly connected to and an integral part of said crankshaft for rotation therewith in the same direction, a second compensating mass means rotatably mounted on said crankshaft, and, gear means associated with said crankshaft and said second compensating mass means and constructed and arranged in a manner to rotate said second compensating mass means in a direction opposite to said crankshaft and said first compensating mass means for the compensation of the inertial forces produced by the moving masses of said frame and said first compensating mass means, said gear means comprising a bevel gear drive set comprising:

a first bevel gear secured to said crankshaft for rotation in the same direction thereof, a second bevel gear mounted on said crankshaft for rotation relative thereto and secured to said second compensating mass means, a third bevel gear meshing with said first and said second bevel gears to cause said opposite rotation of said second compensating mass means, and said first and said second compensating mass means having an axis of rotation which is coaxial relative to each other and to said crankshaft.

2. A pilger mill according to claim 1 further including a housing for said crank assembly and a shaft mounted in said housing for carrying said third bevel gear.

3. A pilger mill according to claim 1 wherein said drive means is connected to said crankshaft, and wherein said second compensating mass means is eccentrically mounted.

4. A pilger mill according to claim 1, wherein said gear means further includes:

a second bevel gear drive set in alignment with said first bevel gear drive set, and a driving shaft mounted in said housing for carrying said second bevel gear drive set, and connected to said drive means, and wherein said shaft of said third bevel gear of said first bevel gear drive set is a power take-off shaft.

5. A pilger mill according to claim 4 further comprising:

a third compensating mass means, an auxiliary shaft for securely mounting said third compensating mass means for rotation therewith, a gearing arrangement for kinematically connecting said third compensating mass means to said crankshaft and being such that said auxiliary shaft rotates at twice the rate of speed as said crankshaft.

6. A pilger mill according to claim 5 wherein the mass of said third compensating mass means is at most half as much as that of said second compensating mass means.

* * * * *